US009551216B2

(12) United States Patent
Nieuwoudt et al.

(10) Patent No.: US 9,551,216 B2
(45) Date of Patent: Jan. 24, 2017

(54) PACKER ELEMENT WITH LAMINAR FLUID ENTRY

(71) Applicant: BAKER HUGHES INCORPORATED, Houston, TX (US)

(72) Inventors: Hermanus J. Nieuwoudt, Tomball, TX (US); Christopher Morgan, Spring, TX (US); Francisco Galvan, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 348 days.

(21) Appl. No.: 14/286,636

(22) Filed: May 23, 2014

(65) Prior Publication Data

US 2015/0337655 A1 Nov. 26, 2015

(51) Int. Cl.
*E21B 49/10* (2006.01)

(52) U.S. Cl.
CPC ..... *E21B 49/10* (2013.01)

(58) Field of Classification Search
CPC ..... E21B 49/08; E21B 49/10; E21B 33/12
See application file for complete search history.

(56) References Cited

U.S. PATENT DOCUMENTS 3,726,343 A * 4/1973 Davis, Jr. ..... E21B 23/06 166/124
5,058,676 A 10/1991 Fitzpatrick et al.
6,026,915 A 2/2000 Smith et al.
7,036,362 B2 5/2006 Haddad et al.
7,077,208 B2 7/2006 Harrington et al.
RE41,118 E * 2/2010 Brezinski ..... E21B 33/12 166/187
7,980,306 B2 7/2011 Lovell et al.
8,230,916 B2 7/2012 Sumrall et al.
8,424,604 B2 4/2013 Mosing et al.
8,567,500 B2 10/2013 Bedouet et al.
2011/0315372 A1 12/2011 Church
2013/0062073 A1 3/2013 Landsiedel
(Continued)

FOREIGN PATENT DOCUMENTS

WO 2013008195 A2 1/2013
WO 2013082433 A1 6/2013

OTHER PUBLICATIONS http://www.slb.com—MST Dual-Packer Module.
(Continued)

*Primary Examiner* — John Fitzgerald
(74) *Attorney, Agent, or Firm* — Mossman Kumar & Tyler PC

(57) ABSTRACT

An apparatus for retrieving a fluid from a sampling zone in a borehole intersecting a formation may include a sampling tool having a port positioned in the sampling zone and a permeable media filling an annular space surrounding the port. The permeable media may include a circumferential support face, a first plurality of radial flow channels, and a second plurality of radial flow channels. The support face extends axially and uniformly along a length of the sampling zone. The circumferential support face contacts a borehole wall. The first plurality of radial flow channels conveys fluid between the borehole wall and the port. The second plurality of radial flow channels conveys fluid between the borehole wall and a location isolated from the port.

20 Claims, 4 Drawing Sheets

(56) References Cited

U.S. PATENT DOCUMENTS

| | | | | |
|---|---|---|---|---|
| 2013/0248178 | A1* | 9/2013 | Hecker | E21B 33/12 166/278 |
| 2013/0248179 | A1* | 9/2013 | Yeh | E21B 23/06 166/278 |

OTHER PUBLICATIONS http://www.slb.com—New Diminesions in Wireline Formation Testing, (2013).
http://cgiss.boisestate.edu—The Influence of Wellbore Inflow on Electromagnetic Borehole Flowmeter Measurements, (Jul. 2009).

* cited by examiner

PACKER ELEMENT WITH LAMINAR FLUID ENTRY

CROSS-REFERENCE TO RELATED APPLICATIONS

Field of the Disclosure

This disclosure pertains generally to investigations of underground formations and more particularly to devices and methods for sampling fluids in a borehole.

BACKGROUND OF THE DISCLOSURE

Commercial development of hydrocarbon producing fields requires significant amounts of capital. Before field development begins, operators desire to have as much data as possible in order to evaluate the reservoir for commercial viability. Therefore, numerous tests are performed during and after drilling of a well in order to obtain data regarding the nature and quality of the formation fluids residing in subsurface formations. As is known, the quality of the samples obtained during these tests heavily influences the accuracy and usefulness of the test results.

In one aspect, the present disclosure addresses the need to obtain pristine fluid samples from a subsurface formation.

SUMMARY OF THE DISCLOSURE

In aspects, the present disclosure provides an apparatus for retrieving a fluid from a sampling zone in a borehole intersecting a formation. The apparatus may include a sampling tool having a port positioned in the sampling zone and a permeable media filling an annular space surrounding the port. The permeable media may include a circumferential support face contacting a borehole wall, the support face extending axially and uniformly along a length of the sampling zone, a first plurality of radial flow channels conveying fluid between the borehole wall and the port, and a second plurality of radial flow channels conveying fluid between the borehole wall and a location isolated from the port.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

In aspects, the present disclosure relates to devices and methods for providing enhanced sampling of formation fluids. The teachings may be advantageously applied to a variety of systems both in the oil and gas industry and elsewhere. Merely for clarity, certain non-limiting embodiments will be discussed in the context of tools configured for borehole uses.

Figure 1:
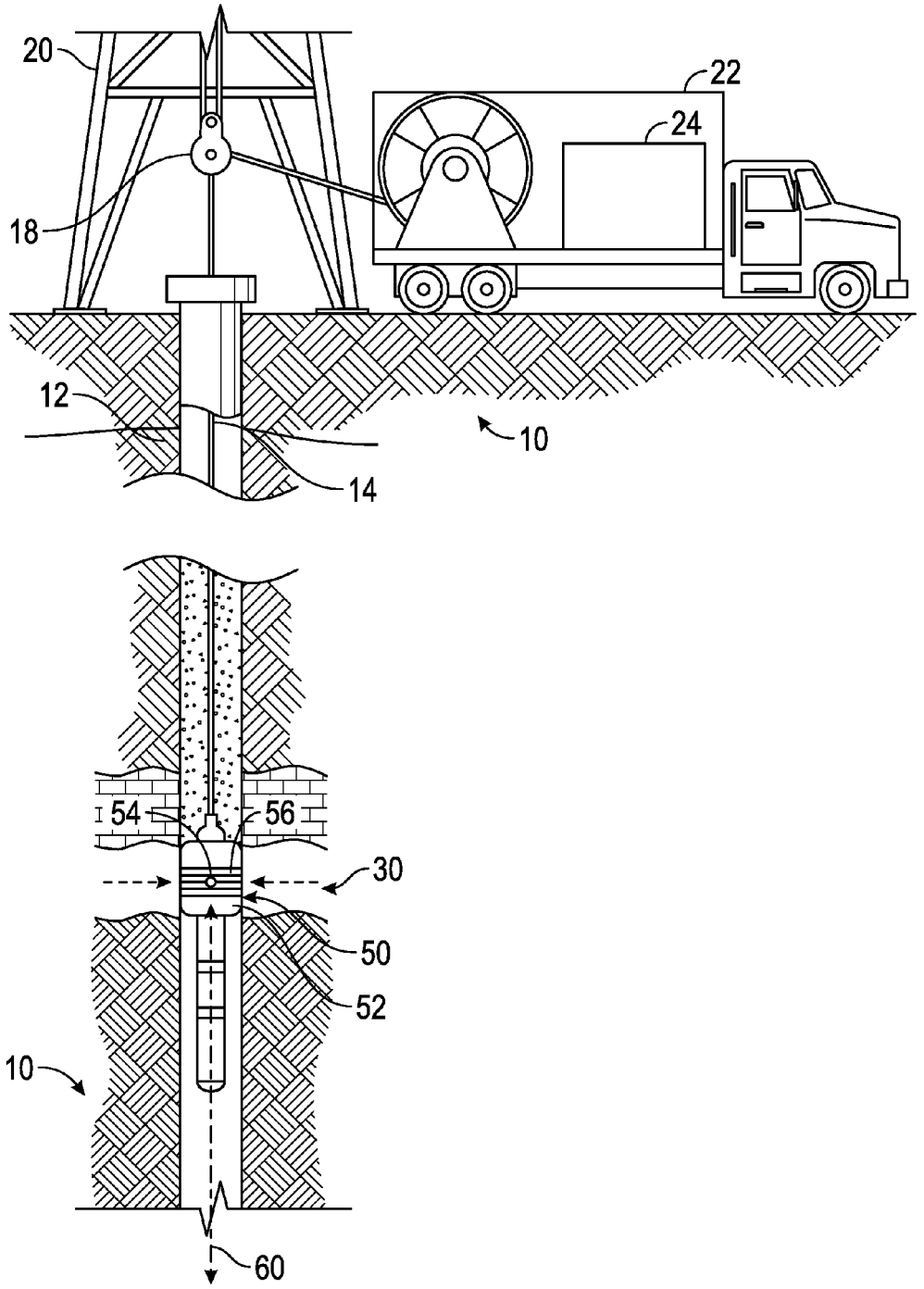
FIG. 1 shows a schematic of a downhole tool deployed in a borehole along a wireline according to one embodiment of the present disclosure.

Referring initially to FIG. 1, there is schematically represented a cross-section of a subterranean formation 10 in which is drilled a borehole 12. Suspended within the borehole 12 at the bottom end of a conveyance device such as a wireline 14 is a downhole assembly 30. The wireline 14 is often carried over a pulley 18 supported by a derrick 20. Wireline deployment and retrieval is performed by a powered winch carried by a service truck 22, for example. A control panel 24 interconnected to the downhole assembly 30 through the wireline 14 by conventional means controls transmission of electrical power, data/command signals, and also provides control over operation of the components in the downhole assembly 30.

The downhole assembly 30 may include a fluid testing module 50. The module 50 may include a sealing element 52 and a fluid port 54. A permeable media 56 fills an annular space 58 surrounding the fluid port 54. The permeable media 56 may be constructed to allow flow only in the plane perpendicular to a longitudinal axis 60 of the module 50. For instance, the permeable media 56 may include multiple layers of passages that fan radially outward from the longitudinal axis 60. Each layer of passages may be hydraulically isolated from an adjacent layer of passages. Segregating fluid in layers of passages transverse to the axis 60 may aid in sampling only the fluid of choice 64 using the fluid port 54.

Figure 2:
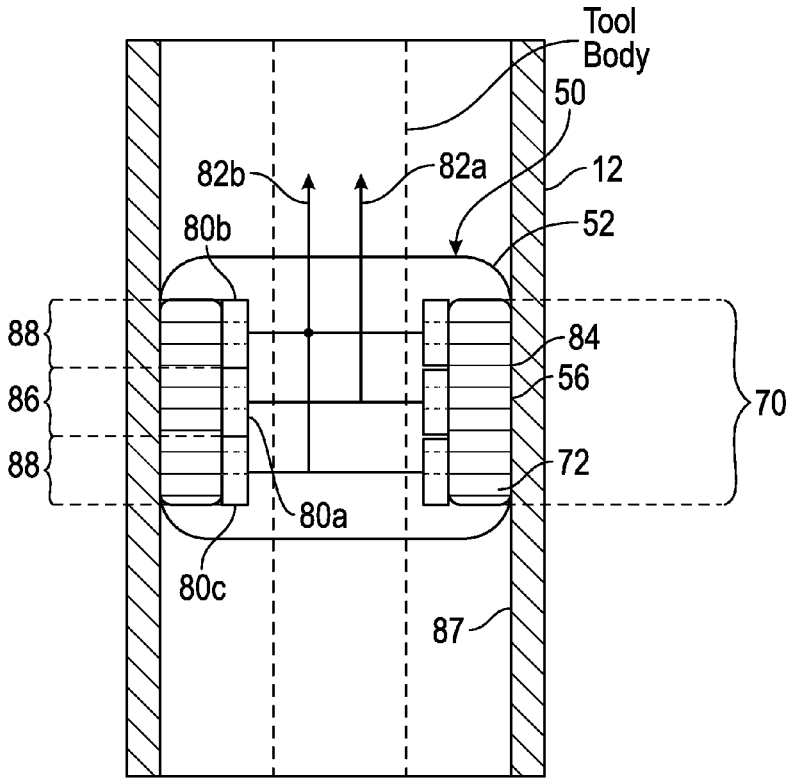
FIG. 2 schematically illustrates in sectional form a portion of a sampling tool having a permeable body connecting a borehole wall to a sampling port according to one embodiment of the present disclosure.

Referring to FIG. 2, there is shown a schematic side view of the fluid testing module 50. The module 50 may include a sealing element 52 configured as a diametrically inflatable packer. The sealing element 52 hydraulically isolates a sampling zone 70 from the remainder of the borehole 12. The module 50 also includes a permeable media 56 filling the sampling zone 70 and a plurality of fluid ports 80A-C positioned inside the sampling zone 70. As will be discussed in greater detail below, the permeable media 56 stratifies fluid flow in the sampling zone 70 using radial flow channels 72. Thus, thus the fluids flowing into the fluid ports 80A-C have not comingled while in the sampling zone 70.

In one arrangement, the fluid ports 80*a-c* may be configured to generate a primary and a secondary fluid inflow. For example, fluid port 80*a* may cause a primary fluid inflow for acquiring samples of the formation fluid. Fluid ports 80*b,c* may cause secondary fluid inflows that reduce contamination of the primary fluid inflow. The ports 80*a-c* may be connected via lines 82*a, b* to a suitable fluid mover, such as pumps (not shown). The fluid ports 80*a-c* may be selectively operated to flow into one or more of the ports 80*a-c* simultaneously. In one arrangement, the fluid inflow from port 80*a* may be directed into a sample tank (not shown). The fluid inflows into port 80*b, c* may be pumped out to the borehole 12.

The permeable media 56 may include a circumferential support face 84 contacting a borehole wall 87, a first set of radial flow channels 86, and a second set of radial flow channels 88. The support face 84 extends axially and uniformly along a length of the sampling zone 70. The support face 84 acts as a vertical perforated wall that prevents the rock and earth making up the borehole wall 87 from collapsing into the sampling zone 70. The first set of radial flow channels 86 conveys fluid between the borehole wall 87 and the port 80*a*. The second set of radial flow channels 88 conveys fluid between the borehole wall and a location isolated from the port 80*a*. As shown, these isolated locations may be ports 80*b, c*.

In embodiments, the permeable media 56 may be a toroid defined by the outer circumferential support face 84, an inner circumferential face 85, and upper and lower faces 89*a, b*. It should be noted that the body of the permeable media 56 is substantially contiguous along the borehole wall 87. Additionally, the inner circumferential face 85 covers the ports 80*a-c*. Thus, fluid in the sampling zone 70 must flow through the inner circumferential face 85 to enter the ports 80*a-c*. It should also be noted that each port 80*a-c* is in fluid communication with the borehole wall 87 via a plurality of flow passages 72.

Figure 3A:
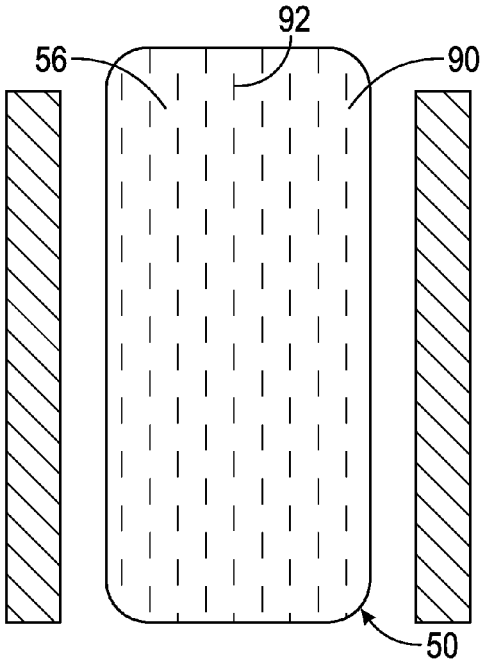
FIGS. 3A-B schematically illustrate a side view of permeable body expanding from a compact "running in" shape to a diametrically expanded operating condition.
Figure 3B:
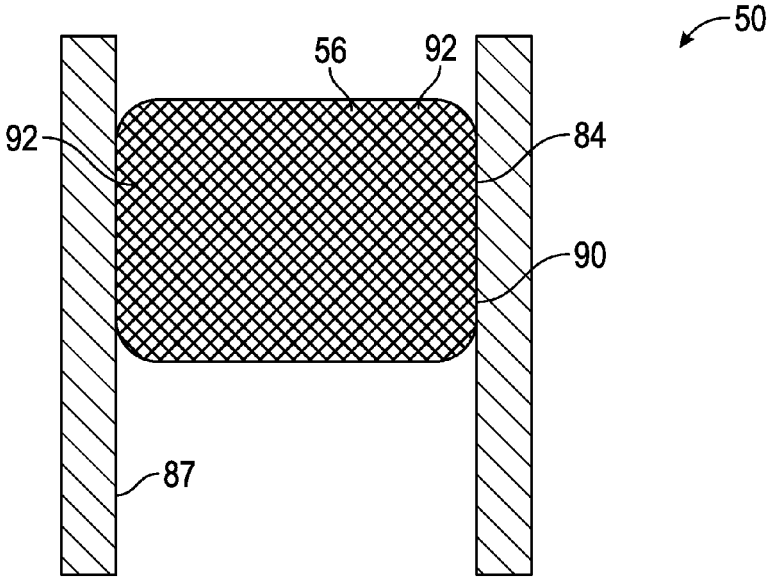

Referring now to FIGS. 3A and B, there is shown a permeable media 56 that expands from a first circumferential size to a second, larger circumferential size. In this embodiment, the permeable media 56 has a substantially solid body 90 that includes radial flow channels 92. The flow channels 92 may resemble spokes of a wheel that radiate from an axle. In FIG. 3A, the body 90 is shown in a pre-activated position wherein the body 90 is axially elongated and flow channels 92 are restricted. In FIG. 3B, the body 90 is shown in an activated position wherein the body 90 has diametrically expanded and flow channels 92 are open. In the open position, the flow channels 92 may resemble straws. The body 90 may be activated by using an axial loading that compresses the body 90. The body 90 when expanding under compression can force out any borehole fluid in the sampling zone 70. Also, the support face 84 of the body 90 can use the pressure to support the borehole wall 87.

Figure 4:
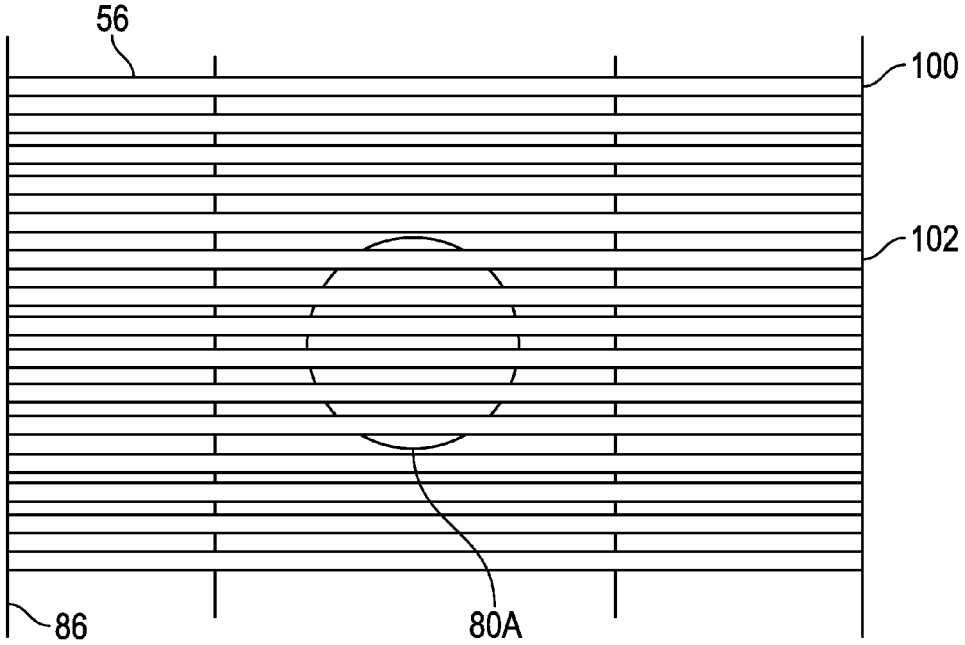
FIG. 4 schematically illustrates a side view of a permeable body formed of a plurality of plates according to one embodiment of the present disclosure.

Referring to FIG. 4, in another embodiment, the permeable media 56 may include a plurality of stacked blades 100. The blades 100 may be interleaved to fold compactly while the tool is conveyed along the borehole. In some embodiments, the blades 100 may be an inverted diaphragm or leaf shutter. For example, the permeable media 56 may include a number of thin blades that slide over each other. A rotation of an inner mandrel (not shown) can fan the blades radially outward. Once positioned, an applied pressure can fan the blades 100 outwardly. The spaces 102 between the blades 100 form radial flow channels between the borehole wall and the port. It should be noted that the blades 100 also segregate flow such that fluid flow towards one port will not comingle with the fluid flow to a different port. Further, as shown, a plurality of flow channels formed by spaces 102 connect the port 80A to the borehole wall 87.

In other variants, the permeable media 56 may be formed in a manner similar to an umbrella. Thus, the blades 100 may be canopies that attached to ribs. The canopies may be expanded by a stretcher and runner assembly. In still other embodiments, the permeable media 56 may be formed in an accordion shape.

Figure 5:
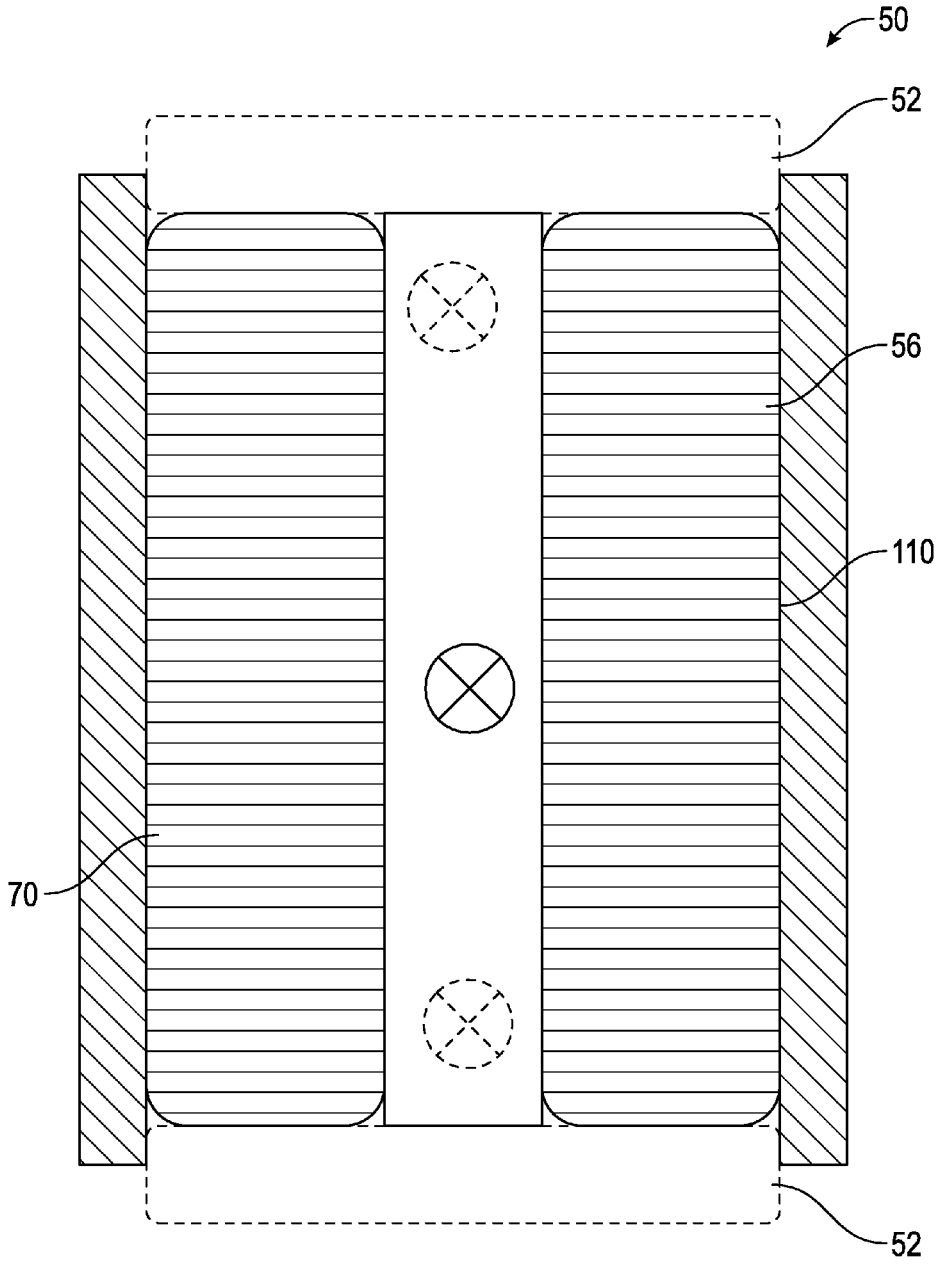
FIG. 5 schematically illustrates a side view of a permeable body according to an embodiment of the present disclosure that is positioned between two separate sealing elements and is formed of a granular or injectable material.

Referring to FIG. 5, there is shown a fluid sampling module 50 that includes a pair of sealing axially spaced apart sealing elements 52 that define the sampling zone 70. In this embodiment, the permeable media 56 may be a granular material. For example, the media 56 may be formed of gravel, sand, beads, or other particles. Additionally, the interaction of the particles can be configured to cause anisotropic flow behavior. Specifically, fluid can easily flow laterally through the permeable media 56 in the sampling zone but encounters significant resistance for flow axially through the sampling zone. For example, the interstitial pores or cells may connect laterally with one another to form radial flow paths. The terms lateral and radial both refer to a direction transverse to the longitudinal axis 60 of the module 50. The granular material may be contained in a permeable bag, bladder, or other expandable containment device 110.

In still another embodiment, the permeable media 56 may include injectable material such as a foam or gel that solidifies after being injected into the sampling zone. The injectable material may be anisotropic. The injectable material may be mechanically broken up after use or dissolved by a suitable solvent.

Referring now to FIGS. 1 and 2, in one illustrative mode of operation, the fluid sampling tool 50 may be conveyed into the borehole 12 with the permeable media 56 in the compact shape shown in FIG. 3A. After being positioned adjacent a formation of interest 10, the permeable media 56 may be compressed or otherwise activated to fill the sampling zone 70. The permeable media 56 displaces resident borehole fluid out of the sampling zone 70 and connects the ports 80*a-c* to the borehole wall 87. Each port 80*a-c* has a plurality of radial flow passages for receiving fluid. Also, the support face 84 contacts and supports the borehole wall 87.

Now, pumps (not shown) may be activated to draw fluid through the permeable media 56. The fluid entering the sampling zone 70 are confined to a laminar flow wherein a fluid along one radial path does not comingle with the fluid flowing along an axially adjacent radial flow path. Thus, the radial flow passages are hydraulically isolated from one another while in the sampling zone 70. Thus, the supplemental ports 80*b, c* draw away fluid that would otherwise comingle with the fluid entering the ports 80*a*.

While a wireline conveyance system has been shown, it should be understood that embodiments of the present disclosure may be utilized in connection with tools conveyed via rigid carriers (e.g., jointed tubular or coiled tubing) as well as non-rigid carriers (e.g., wireline, slick line, e-line, etc.). Some embodiments of the present disclosure may be deployed along with Logging While Drilling/Measurement While Drilling (LWD/MWD) tools.

While the foregoing disclosure is directed to the one mode embodiments of the disclosure, various modifications will be apparent to those skilled in the art. It is intended that all variations be embraced by the foregoing disclosure.

We claim:

1. An apparatus for retrieving a fluid from A sampling zone in a borehole intersecting a formation, the apparatus comprising:

a sampling tool having a port positioned in the sampling zone; and a permeable media filling an annular space surrounding the port, the permeable media having:

a circumferential support face contacting a borehole wall, the support face extending axially and uniformly along a length of the sampling zone, a first plurality of radial flow channels conveying fluid between the borehole wall and the port, and a second plurality of radial flow channels conveying fluid between the borehole wall and a location isolated from the port.

2. The apparatus of claim 1, wherein the permeable media includes a plurality of radially radiating blades, wherein the first and the second plurality of radial flow channels are formed by the spaces separating the blades.

3. The apparatus of claim 1, wherein the permeable media includes an injectable material.

4. The apparatus of claim 1, wherein the permeable media is a substantially solid body, and wherein the first and the second plurality of radial flow channels are formed in the body.

5. The apparatus of claim 1, wherein the sampling tool includes a supplemental port positioned at the location isolated from the port.

6. The apparatus of claim 1, further comprising a pressure applicator applying a compressive force on the permeable media, wherein the circumferential support face pressurizes the borehole wall in response to the applied compressive force.

7. The apparatus of claim 1, wherein the permeable media includes a second inner circumferential face covering the port.

8. The apparatus of claim 1, wherein the fluid in the first plurality of the radial flow channels does not comingle with the fluid in the second plurality of radial flow channels while in the sampling zone.

9. The apparatus of claim 1, wherein the permeable media is expandable between a first circumferential size and a second, larger circumferential size.

10. The apparatus of claim 9, wherein the permeable media expands to the second, larger circumferential size in response to an applied pressure.

11. The apparatus of claim 1, wherein the permeable media includes a granular material.

12. The apparatus of claim 11, further comprising a permeable bag in which the granular material is disposed.

13. A method for retrieving a fluid from a sampling zone in a borehole intersecting a formation, the apparatus comprising:

positioning a sampling tool adjacent to the formation, the sampling tool having a port in the sampling zone;

filling an annular space surrounding the port with a permeable media, the permeable media having a circumferential support face contacting the borehole wall;

supporting a borehole wall with the support face, the support face extending axially and uniformly along a length of the sampling zone;

conveying fluid between the borehole wall and the port using a first plurality of radial flow channels; and conveying fluid between the borehole wall and a location isolated from the port using a second plurality of radial flow channels.

14. The method of claim 13, further comprising conveying the permeable media into the borehole in a first compact shape; and expanding the permeable media to a second, larger circumferential size.

15. The method of claim 13, wherein the permeable media includes a plurality of radially radiating blades, wherein the first and the second plurality of radial flow channels are formed by the spaces separating the blades.

16. The method of claim 13, wherein the permeable media includes one of (i) a granular material, and (ii) an injectable material.

17. The apparatus of claim 13, further comprising enclosing the permeable media in a permeable bag.

18. The method of claim 13, wherein the permeable media is a substantially solid body, and wherein the first and the second plurality of radial flow channels are formed in the body.

19. The method of claim 13, further comprising drawing fluid through at least one supplemental port positioned at the location isolated from the port.

20. The method of claim 13, wherein the permeable media includes a second inner circumferential face covering the port.

* * * * *